US005517749A

United States Patent [19]

Zuin

[11] Patent Number: 5,517,749

[45] Date of Patent: May 21, 1996

[54] ELECTRICAL TERMINAL APPLICATOR WITH IMPROVED CRIMP HEIGHT ADJUSTMENT PLATE MEANS

[75] Inventor: Gianni Zuin, Mestrino-Padova, Italy

[73] Assignee: Molex Incorporated, Lisle, Ill.

[21] Appl. No.: 289,486

[22] Filed: Aug. 11, 1994

[30] Foreign Application Priority Data

Sep. 14, 1993 [EP] European Pat. Off. ..... 93114720
Feb. 24, 1994 [EP] European Pat. Off. ..... 94102752

[51] Int. Cl.[6] ..... H01R 43/048; B21J 13/02

[52] U.S. Cl. ..... 29/753; 29/33 M; 72/413; 72/446

[58] Field of Search ..... 29/33 M, 753, 29/863; 72/413, 441, 446, 481; 100/257

[56] References Cited

U.S. PATENT DOCUMENTS

| | | | |
|---|---|---|---|
| 3,687,069 | 8/1972 | Helrigel et al. | 72/446 X |
| 3,911,717 | 10/1975 | Yuda | 72/331 |
| 4,587,725 | 5/1986 | Ogawa et al. | 29/753 |
| 4,676,090 | 6/1987 | Nishimura et al. | 72/413 X |
| 4,790,173 | 12/1988 | Boutcher, Jr. | 72/446 |
| 4,970,889 | 11/1990 | Phillips et al. | 72/446 |
| 5,033,283 | 7/1991 | Gloe et al. | 72/481 |
| 5,095,599 | 3/1992 | Gloe et al. | 29/33 M |
| 5,275,032 | 1/1994 | Gloe et al. | 29/753 X |
| 5,289,713 | 3/1994 | Schafer | 72/446 |
| 5,323,634 | 6/1994 | Wolfe et al. | 72/446 |
| 5,337,589 | 8/1994 | Gloe et al. | 29/753 X |

FOREIGN PATENT DOCUMENTS

| | | | |
|---|---|---|---|
| 279036 | 8/1988 | European Pat. Off. | 29/753 |
| 9106138 | 5/1991 | WIPO | 29/753 |

*Primary Examiner*—Peter Vo
*Attorney, Agent, or Firm*—Charles S. Cohen

[57] ABSTRACT

An electrical terminal applicator includes an applicator ram drivable by a press ram through a working stroke towards, and a return stroke away from, a crimping anvil. A first crimping die is mounted on the applicator ram for cooperation with the anvil to crimp a first portion of an electrical terminal onto an exposed end of a conductive core of an insulated electrical wire during each working stroke of the applicator ram. A second crimping die is mounted on the applicator ram for cooperation with the anvil to crimp a second portion of the terminal onto the insulation of the electrical wire during each working stroke of the applicator ram. A first adjusting plate is mounted for rotation about an axis on and extending in the direction of movement of the applicator ram to selectively interpose projections between the press ram and the applicator ram to adjust the shut height of the first and second crimping dies. A second adjusting plate is mounted for rotation about the axis for selectively interposing projections between the first adjusting plate and the second crimping die to adjust the shut height of the second die. A third adjusting plate in the form of a thin flexible disc is mounted for rotation about the axis.

19 Claims, 5 Drawing Sheets

ELECTRICAL TERMINAL APPLICATOR WITH IMPROVED CRIMP HEIGHT ADJUSTMENT PLATE MEANS

FIELD OF THE INVENTION

This invention generally relates to the art of electrical terminal applicators and, particularly, to an improved crimp height adjustment plate means therefor.

BACKGROUND OF THE INVENTION

A known type of electrical terminal applicator includes an applicator ram drivable by a press ram through a working stroke towards, and a return stroke away from, a crimping anvil. The applicator ram has a first crimping die for cooperation with the anvil to crimp a first portion of an electrical terminal onto an exposed end of a conductive core of an insulated electrical wire during each working stroke of the applicator ram. The applicator ram has a second crimping die for cooperation with the anvil to crimp a second portion of the terminal onto the insulation of the electrical wire during each working stroke of the applicator ram. The second crimping die is adjustable axially of the applicator ram. Plate means are mounted for angular adjustment about an axis on, and extending lengthwise of, the applicator ram. The plate means selectively interpose first projections between the press ram and the applicator ram to adjust the shut height of the first and second dies, and selectively interpose second projections between the applicator ram and the second crimping die to independently adjust the shut height of the second die.

In this known terminal applicator, the plate means include two calibrated plates which are independently angularly adjustable manually about the axis of the applicator ram. One of the plates carries the projections for adjusting the shut heights of both the first and second dies, and the other plate carries the projections for adjusting the shut height of the second die. Thus, for each position of adjustment of the first die there are a plurality of positions of adjustment of the second die. An example of this type of known applicator is shown in U.S. Pat. No. 4,718,160 to Bulanda, dated Jan. 12, 1988.

An applicator is known in the prior art having three stacked, calibrated discs or plates, each being on the order of 5 mm thick. The upper ring has upwardly directed projections to adjust both the insulation and conductor crimp heights. The lower ring has downwardly directed projections that contact the insulation crimp tooling for addition adjustment thereof independent of the conductor crimp height. The middle ring also has downwardly directed projections that contact that conductor crimp tooling for adjustment thereof independent of the insulation crimp height. The lower ring is generally annular to permit the projections of the middle ring to extend through the plane of the lower ring and contact the conductor crimp tooling. Because of the thickness of the discs, adding a third calibrated disc would require significant modifications of the tool for housing the applicator ram.

This invention is directed to a novel calibrated disc which can be retrofitted on existing applicator rams without requiring significant modifications of the existing ram housings and other operative mechanisms associated with the applicator tool.

SUMMARY OF THE INVENTION

An object, therefore, of the invention is to provide an electrical terminal applicator of the character described, with an improved crimp height adjustment plate means therefor.

As disclosed herein, an electrical terminal applicator includes an applicator ram drivable by a press ram through a working stroke towards, and a return stroke away from, a crimping anvil. A first crimping die is mounted on the applicator ram for cooperation with the anvil to crimp a first portion of an electrical terminal onto an exposed end of a conductive core of an insulated electrical wire during each working stroke of the applicator ram. A second crimping die is mounted on the applicator ram for cooperation with the anvil to crimp a second portion of the terminal onto the insulation of the electrical wire during each working stroke of the applicator ram.

A first adjusting plate means is mounted for angular adjustment about an axis on and extending in the direction of movement of the applicator ram to selectively interpose projection means between the press ram and the applicator ram to adjust the shut height of both the first and second dies. A second adjusting plate means is mounted for angular adjustment about the axis to selectively interpose projection means between the first adjusting plate means and the second die to adjust the shut height of the second die. A third adjusting plate means is mounted for angular adjustment about the axis to selectively interpose projection means between the press ram and the first adjusting plate means to provide further fine adjustment of the shut height of the first die and, in turn, the shut height of the second die.

Generally, the invention contemplates that the third adjusting plate means includes a flexible adjusting plate mounted for rotation about the axis to selectively interpose projection means between the press ram and the first adjusting plate means to provide further adjustment of the shut height of the crimping die. In one embodiment of the invention, the flexible adjusting plate is a thin flexible disc having a plurality of apertures arranged in a circle concentric about the axis. A plurality of precision machined diskettes of a greater thickness than the thin disc are mounted in the apertures therein. The diskettes have varying thicknesses to provide a range of adjustments.

As disclosed herein, the thin flexible disc is fabricated of sheet metal material. The apertures in the disc include small tabs projecting radially inwardly of the peripheries of the apertures. Each diskette includes tab-receiving recess means in the periphery thereof, whereby the diskettes can be snapped into positions in the apertures with the tabs snapping into the recess means. The recess means may be provided by a peripheral groove about each of the diskettes. The peripheral groove about each diskette may be wider than the thickness of the disc to permit the diskettes to move relative to the disc. In an alternative embodiment, the width of the groove about each diskette is equal to or slightly greater than the thickness of the disc, and the disc could be made flexible, even being fabricated of plastic or other materials.

Indexing means also are provided to hold the thin flexible disc in any one of a plurality of discrete positions of angular adjustment. In the preferred embodiment, the indexing means are provided by a plurality of detent openings in the disc and a spring loaded detent ball biased axially toward the disc for positioning in one of the detent openings.

In a further embodiment of the invention, the disc and diskettes are replaced by a single machined disc which has trapezoidal shaped portions about the periphery thereof, the portions being separated by slots. The portions are machined thin enough so that they are flexible in order to permit the portions to move up and down in the same manner as the diskettes.

In still another embodiment of the invention, a second disc is juxtaposed over the first disc which mounts the diskettes. The second disc has enlarged openings for accommodating the diskettes, and the second disc solidifies the assembly. The second disc also reduces vibration during the crimping operation.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
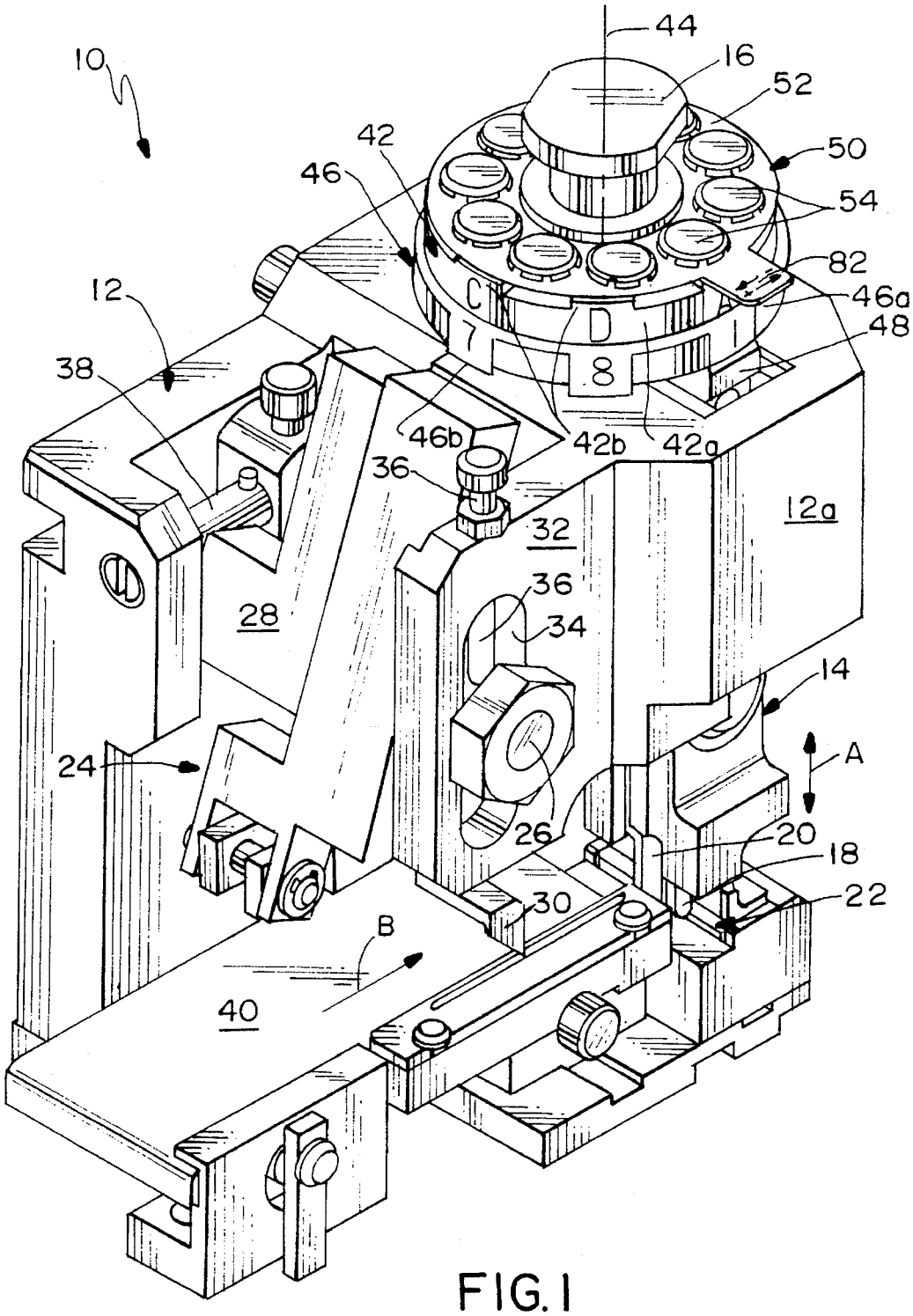
FIG. 1 is a perspective view of a portion of an applicator for crimping electrical terminals to stripped end portions of insulated electrical wires, the applicator including crimp height adjustment plate means according to the invention.

Referring to the drawings in greater detail, and first to FIG. 1, an electrical terminal applicator, generally designated 10, includes a frame, generally designated 12, which, in turn, includes an applicator ram housing 12*a* in which is mounted an applicator ram, generally designated 14, for vertical reciprocating motion within the housing in the direction of double-headed arrow "A". An adaptor head 16 projects upwardly of applicator ram 14 for engagement by a press ram 60 (FIGS. 2 and 3), as described hereinafter. An insulation crimping die 18 projects from the bottom of applicator ram 14, beneath housing 12*a*, and is juxtaposed with a conductive core crimping die 20 also projecting from the applicator ram beneath housing 12*a*. Die 18 is positioned forwardly of die 20 when viewed in FIG. 1. A crimping anvil means, generally designated 22, is located on frame 12 beneath crimping dies 18 and 20.

In the general operation of applicator 10, applicator ram 14 is drivable by means of press ram 60 (described hereinafter) through a working stroke towards, and a return stroke away from, crimping anvil means 22, as indicated by double-headed arrow "A". First or rear crimping die 20 cooperates with anvil means 22 to crimp a first portion of an electrical terminal onto an exposed end of a conductive core of an insulative electrical wire during each downward working stroke of applicator ram 14. Second or front crimping die 18 cooperates with anvil means (not shown) to crimp a second portion of the terminal onto the insulation of the electrical wire during each downward working stroke of the applicator ram.

Still referring to FIG. 1, a terminal strip feed assembly, generally designated 24, is secured between frame 12 and housing 12*a* and includes a pivot pin 26, a rocker arm 28 and a feed finger 30 which is loaded by a return spring (not shown). The return spring is behind a brace portion 32 of housing 12*a* and is provided by a torsion coil spring about pin 26. The pivot pin is adjustable lengthwise of a slot 34 in brace 32 to determine the end positions of feed finger 30. In other words, adjustment of the location of the pivot point defined by pin 26 adjusts the length of stroke of feed finger 30. The pivot pin is adjustable by means of a screw 36. Rocker arm 28 is swung about pivot pin 26 by means of a slidable rod 38 (by means not shown) to feed a strip of terminals along a platen 40 in the direction of arrow "B" toward anvil means 22 to locate the leading terminal of the strip on the anvil. As the press ram drives applicator ram 14 downwardly as described above, crimping dies 18 and 20 are effective to crimp the lead terminal onto the stripped end of the insulated electrical wire. The press ram/applicator ram are cycled in unison with the operation of rocker arm 28 and feed finger 34 to incrementally advance terminals from the strip thereof to the crimping station defined by anvil means 22 and crimping dies 18 and 20.

Generally, a plurality of adjusting plate means are provided for adjusting the shut heights of crimping die 18 and/or crimping die 20. Specifically, a first adjusting plate means, generally designated 42, is mounted for angular adjustment about an axis 44 on and extending in the direction of movement of applicator ram 14. The first adjusting plate means includes a relatively massive cast circular plate 42*a* having four pairs of diametrically opposed upwardly directed projections 42*b*. Both projections of each pair are the same height while each pair is a different height when compared to the other pairs. A selected pair of projections is aligned with abutments 56 of a press ram 60 to transmit the crimping force from the press ram to the applicator ram. Turning the first adjusting plate 42 changes the height of the projections aligned with the abutments 56 and therefore adjusts the shut height of crimping die 20 which is at a constant or fixed position on applicator ram 14.

A second adjusting plate means, generally designated 46, is mounted for angular adjustment about axis 44. The second adjusting plate means includes a relatively massive cast circular plate 46*a* having eight downwardly directed projections 46*b* of differing heights for interposing between the first adjusting plate and a slide 48 which is positioned adjacent the front or second crimping die 18. Slide 48 is secured to ram 14 by bolt 49.

In operation of first and second adjusting plate means 42 and 46, adjusting plate 42*a* is rotated to bring a pair of projections 42*b* into position for effectively adjusting the stroke of the entire applicator ram, including both crimping dies 18 and 20 in response to actuation thereof by the press ram. As stated above, crimping die 20 is provided for crimping the terminal onto the conductive core of the insulated electrical wire. However, because of a significantly greater range in the diameters of the insulation of electrical wires, insulation crimping die 18 requires additional shut height adjustment, and second adjusting plate means 46 is provided for that purpose. Specifically, adjusting plate 46*a* is rotated to bring a projection 46*b* into alignment with the top of slide 48 which controls the shut height of the front insulation crimping die 18. Therefore, for each increment of adjustment provided by the number of upwardly directed projections 42*b* of first adjusting plate means 42, additional multiple incremental adjustments are provided by the number of downwardly directed projections 46*b* of second adjusting plate means 46.

The invention herein is directed to an improvement in providing fine shut height adjustment for crimping dies 18 and 20, without significantly modifying applicator 10 in the areas of frame 12, housing 12*a*, terminal strip feed assembly 28, platen 40 and anvil means 22. In essence, the additional adjusting means of the invention requires modifications only to applicator ram 14 in such a manner that the ram can be replaced by a modified applicator ram, including the adjusting means of the invention, and thereby to retrofit an existing applicator machine. With reference to FIG. 1, the invention is embodied in a third adjusting plate means, generally designated 50, and which includes a thin flexible disc 52 mounting a plurality of diskettes 54 of varying thicknesses.

Figure 2:
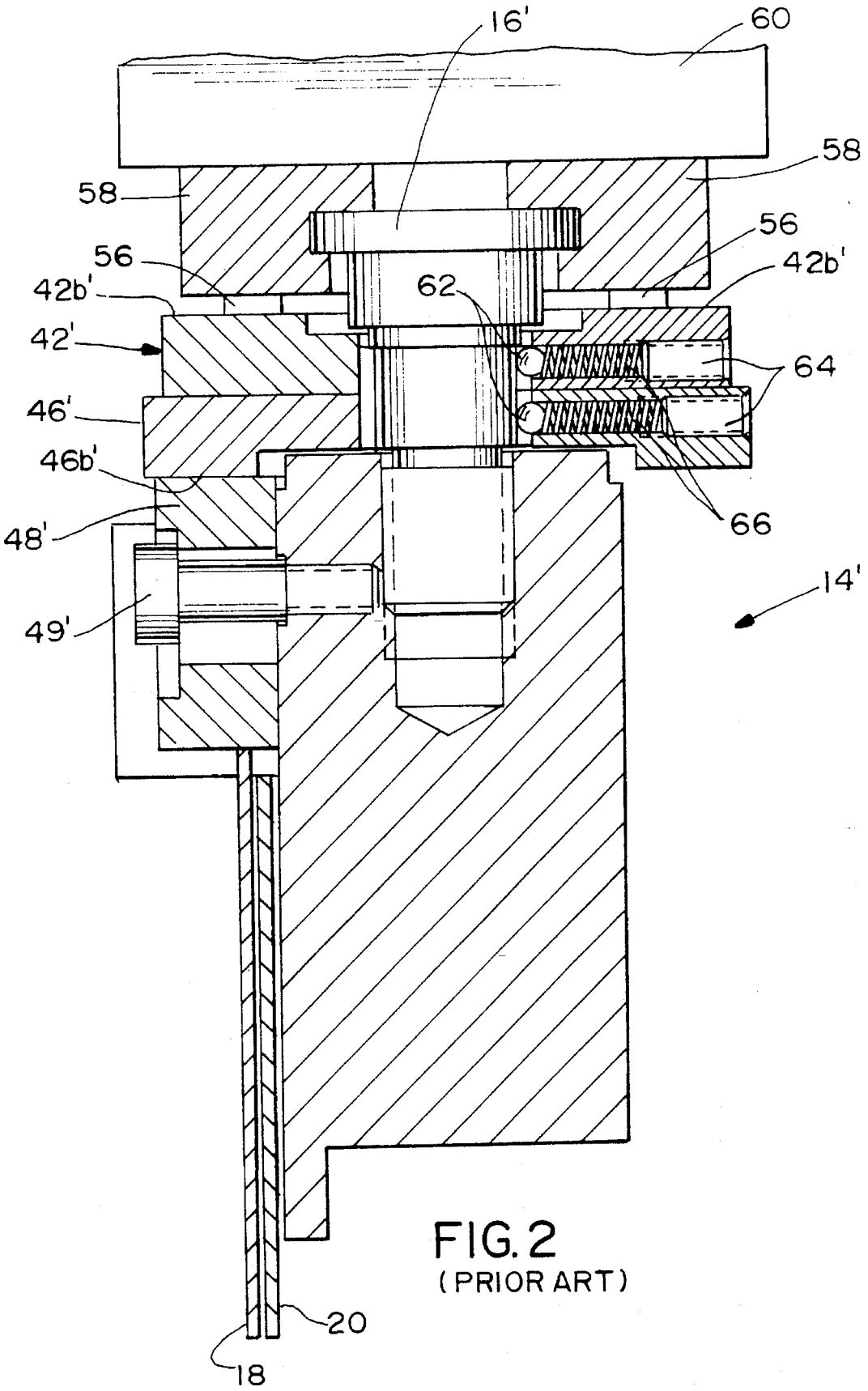
FIG. 2 (PRIOR ART)
FIG. 2 is a vertical section through an applicator ram according to the prior art.

Before proceeding with a detailed description of the third adjusting plate means 50 of the invention, reference is made generally to FIG. 2 wherein an applicator ram, generally designated 14' is shown according to the prior art. Like the structure described above in relation to FIG. 1, applicator ram 14' includes an adaptor head 16' at the top thereof, a slide 48' at the side for an insulation crimping die 18' a first adjusting plate means, generally designated 42' a second adjusting plate means, generally designated 46' and crimping die 20'. The first adjusting plate means includes upwardly directed projections 42*b*' for engagement by respective abutments 56 depending downwardly from a pair of opposed claws 58. The claws depend from a press ram 60 and embrace adaptor head 16 of the applicator ram. Detent means, including detent balls 62 and set screws 64, with coil springs 66 sandwiched therebetween, also are shown for indexing first and second adjusting plate means 42' and 46' respectively.

Figure 3:
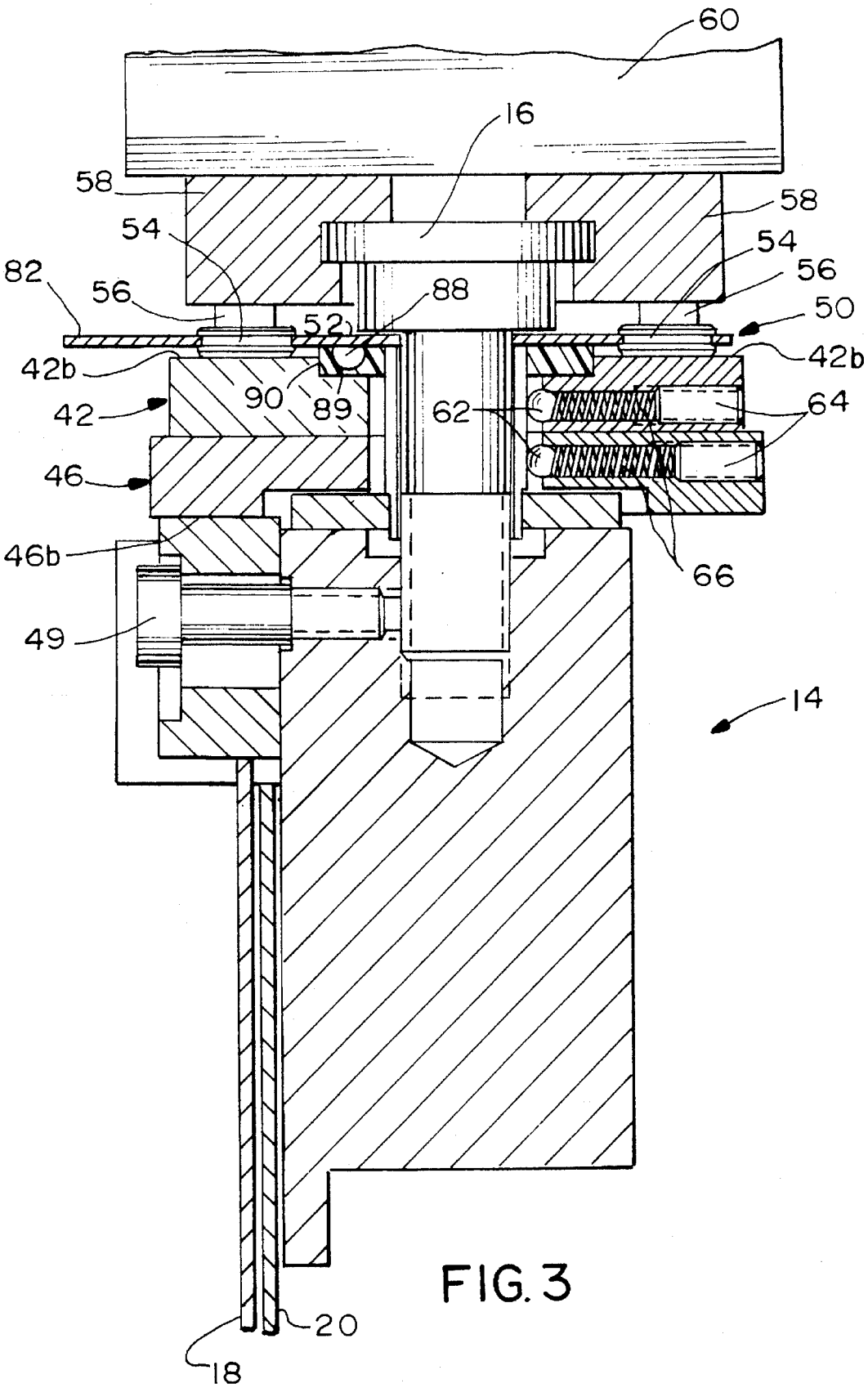
FIG. 3 is a vertical section through an applicator ram according to the invention.

The purpose of showing an applicator ram 14' of the prior art in FIG. 1 (i.e. with only two adjusting plate means 42' and 46') is to compare the configuration of the prior applicator ram with applicator ram 14 shown in FIG. 3 and which includes third adjusting plate means 50 embodying the concepts of the invention. It can be seen that the overall dimensions of the applicator rams 14 and 14' are substantially identical and, therefore, the two applicator rams are interchangeable within applicator 10 (FIG. 1). Consequently, because third adjusting plate means 50 is not a relatively massive adjusting plate means, an existing applicator 10 can be retrofitted with the entire assembly shown in FIG. 3 and, thereby, significantly increase the adjustment capabilities of the applicator.

Figure 4:
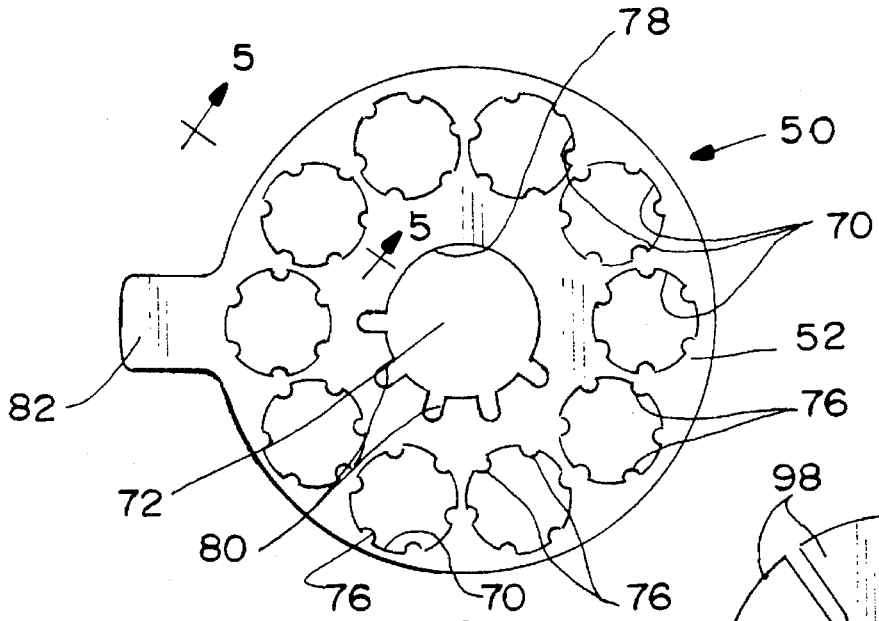
FIG. 4 is a plan view of the thin flexible disc comprising the adjusting plate means of the invention.

Referring next to FIG. 4 in conjunction with FIGS. 1 and 3, thin flexible disc 52 of third adjusting plate means 50 is fabricated of flexible sheet metal material and includes ten apertures 70 equally spaced and concentric about a center point 72 of the disc which coincides with axis 44 (FIG. 1) of applicator ram 14. While the first and second adjusting plates 42 and 46 are approximately 5 mm thick, disc 52 is only approximately 0.6 mm thick. Each aperture has a plurality of small tabs 76 projecting radially inwardly of the periphery of the aperture. These tabs facilitate snapping diskettes 54 (FIGS. 1 and 5) in position within apertures 70, as described hereinafter. FIG. 4 also shows that a center hole 78 of flexible disc 52 includes a plurality of indexing openings 80 cut into the periphery of the center hole. Lastly, FIGS. 1 and 4 shows a manually graspable tongue 82 projecting outwardly from the periphery of flexible disc 52 to facilitate manual rotatable adjustment of the disc.

Figure 5:
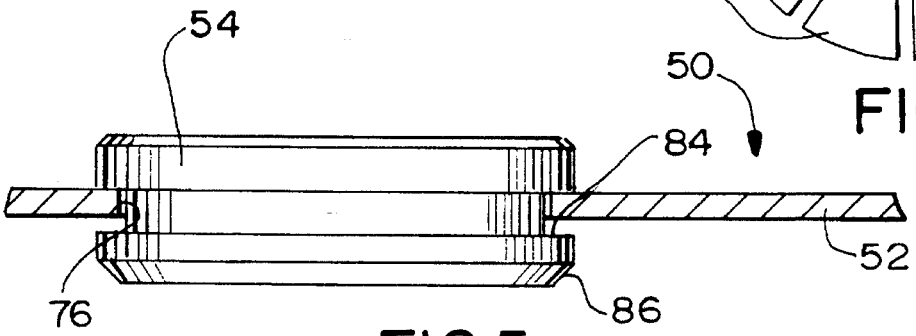
FIG. 5 is a fragmented section view through the disc, taken generally along line 5—5 of FIG. 4, and including one of the diskettes mounted in an aperture in the disc.

Referring to FIG. 5 in conjunction with FIGS. 1, 3 and 4, it can be seen that each diskette 54 has a peripheral groove 84 for receiving tabs 76 within apertures 70 (FIG. 4) of flexible disc 52. The lower edge 86 of each diskette 54 is chamfered to ease insertion of the diskette into a respective aperture in the direction of arrow "C" as tabs 76 pass about the diskette and snap into peripheral groove 84 thereof. The diskettes are arranged in diametrically opposed pairs on disc 52. Each pair of diskettes 54 are manufactured with a different thickness when compared to the thickness of diskettes of other pairs. It is currently contemplated that such diskettes will range in thickness from 2.96 mm to 3.04 mm in 0.02 mm increments. Thus, there will be two diskettes each having a thickness of 2.96 mm, 3.00 mm, 3.02 mm and 3.04mm. Consequently, by indexing disc 52 in order to align a different diskette 54, it is possible to adjust the shut crimp height by 0.02 mm increments. Other increments could be utilized if desired.

Referring back to FIG. 3, a detent ball 88 is mounted in a plastic washer 89 positioned in a recessed area 90 of upper adjusting plate 42*a* of first adjusting plate means 42. Because of the flexibility of disc 52, the disc 52 rides over detent ball 88 until the ball is aligned with one of indexing openings 80 (FIG. 4) to locate the third adjusting plate means 50 in the proper predetermined position with the desired diskettes aligned with the abutments 56 of press ram 60.

Finally, referring to FIG. 1, in operation of the increased adjusting means of the invention, third adjusting plate means 50 can be rotatably adjusted by manually grasping tongue 82 and angularly rotating disk 52 about axis 44 to bring selected ones of diskettes 54 in alignment with the appropriate upwardly directed projections 42*b* of first adjusting plate means 42 that are to be engaged by abutments 56 of press ram 60. With the diskettes being of varying thicknesses, a third multiple of adjustments are provided for both crimping dies 18 and 20 by third adjusting plate means 50, without making any modifications to the frame, housing, feeding mechanism and other related components of applicator 10. Ram 14' (FIG. 2) only need be replaced by ram 14 (FIG. 3) including third adjusting means 50, in order to retrofit the applicator for a significantly increased range of adjustments.

Although the disc 52 is described above as being flexible, the fact that groove 84 in each diskette is wider than the thickness of disc 52 permits the diskettes to move relative to the disc. Accordingly, it is contemplated that disc 52 could be manufactured and arranged without being significantly flexible. In such case, a spring would be positioned beneath detent ball 88 to bias the ball upward toward the indexing openings 80 in order to properly align the disc 52.

Figure 6:
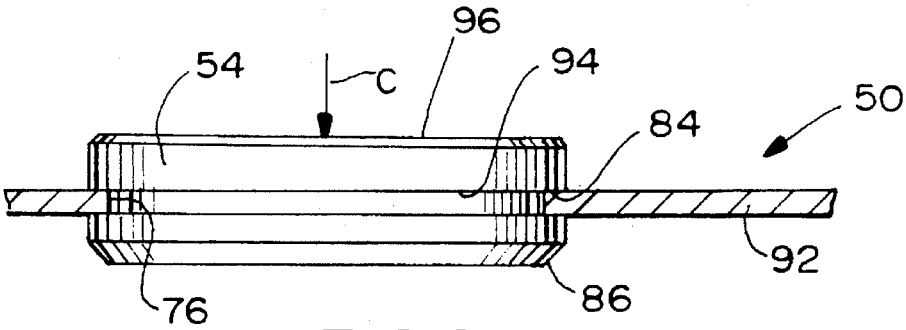
FIG. 6 is a fragmented section view similar to FIG. 5 but showing an alternative embodiment of the disc and diskette.

Various additional alternatives to the embodiment described above are contemplated. For example, the movement of the diskette could be achieved through the use of a relatively flexible disc 92 (FIG. 6). In such case, the width of groove 94 of diskette 96 would be equal to or greater than the thickness of disc 92. In addition to manufacturing the various discs 52 and 92 from sheet metal material, they could be made from plastic or other materials. A disc could be made of plastic in the form of that shown in FIG. 4 or, in the alternative, a plastic disc (not shown) could be overmolded over diskettes 54.

Figure 7:
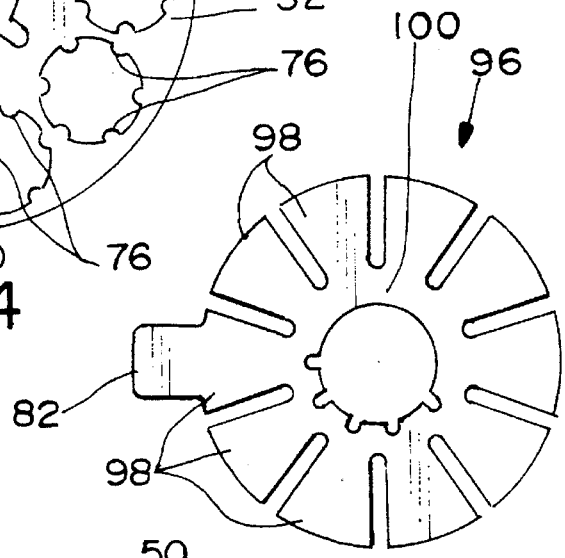
FIG. 7 is a plan view of an alternative embodiment of the disc shown in FIG. 4, but on a reduced scale.

Still another embodiment is shown in FIG. 7. The disc 52 and diskettes 54 are replaced by a single machined disc 96 that is identical to disc 52 except that rather than including diskettes 54, it has generally trapezoidally shaped portions 98. Such portions 98 are machined in the same manner as diskettes 54 as described above. The portions 98 are machined thin enough so that they are flexible or the intersections between portions 98 and central annular portion 100 are thin enough so as to be flexible in order to permit the portions 98 to move up and down in the same manner as diskettes 54.

Figure 9:
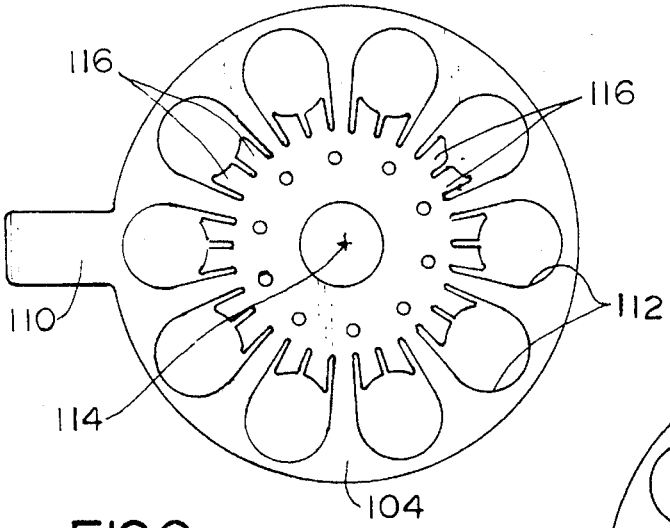
FIG. 9 is a plan view of the thin flexible disc in the embodiment of FIG. 8.
Figure 10:
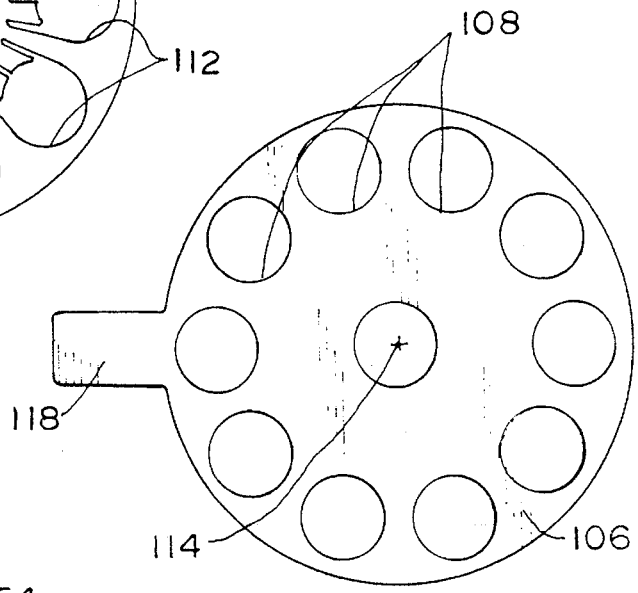
FIG. 10 is a plan view of a second disc incorporated in the embodiment of FIG. 8.
Figure 11:
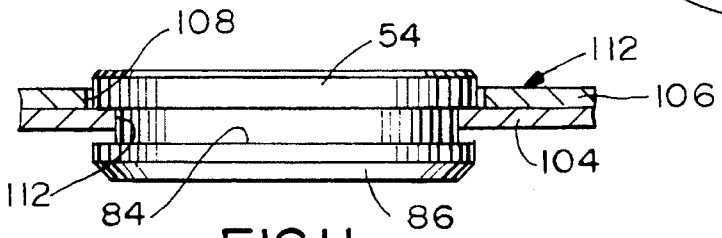
FIG. 11 is an enlarged, fragmented section through the disc assembly of the embodiment of FIG. 8, in the area of one of the diskettes.
Figure 8:
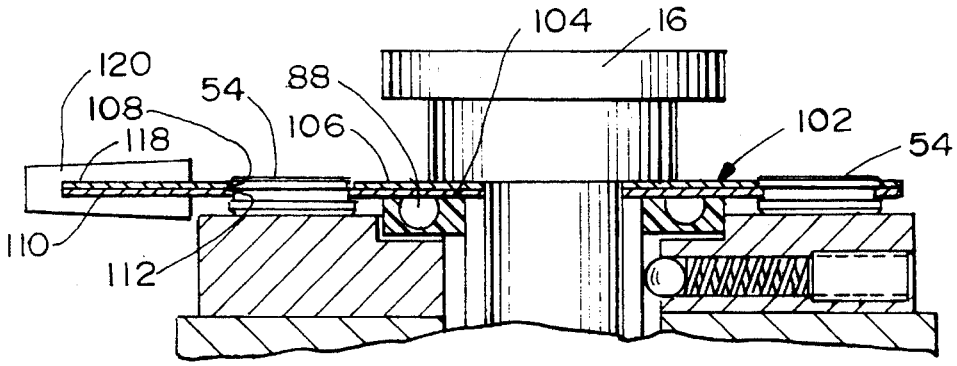
FIG. 8 is a fragmented vertical section through an applicator ram incorporating a further embodiment of the invention.

FIGS. 8–11 show a further embodiment of the invention similar to that of FIGS. 3–5 and, correspondingly, like reference numerals are applied in at least FIGS. 8 and 11, corresponding to like components described above in relation to the embodiment of FIGS. 3–5.

More particularly, the embodiment of FIGS. 8–11 includes a disc assembly, generally designated 102, which includes a first flexible disc 104 corresponding generally in operation and function to disc 52 in the embodiment of FIGS. 3–5. However, disc assembly 102 includes a second flexible disc 106 juxtaposed on top of disc 104, with the second disc including a plurality of apertures 108 for accommodating the tops of diskettes 54. Each diskette, again, has a groove 84 which is wider than the thickness of disc 104.

FIG. 9 shows a plan view of first flexible disc 104 which, again, has a manually graspable tongue 110 projecting outwardly from the periphery of the disc to facilitate manual rotatable adjustment of the disc. The disc includes ten apertures 112 equally spaced and concentric about a center point 114 of the disc which coincides with axis 44 (FIG. 1) of applicator ram 14. Each aperture has a pair of tabs 116 projecting radially inwardly of an inner peripheral portion of the aperture. Like tabs 76 of apertures 70 in FIG. 4, tabs 116 facilitate snapping diskettes 54 in position within apertures 112 as seen in FIGS. 8 and 11.

FIG. 10 shows a plan view of second flexible disc 106 of disc assembly 102, and the second disc includes a manually graspable tongue 118 projecting outwardly from the periphery of the disc, again to facilitate manual rotatable adjustment of the disc. When second disc 106 is juxtaposed over first disc 104, tongue 118 overlies tongue 110, and a plastic handle 120 (FIG. 8) can be press-fit over the juxtaposed tongues. In assembly, second flexible disc 106 is juxtaposed on top of first disc 104, with diskettes 54 projecting through apertures 108 in the second disc as seen clearly in FIG. 11. The second disc provides a more solid disc assembly and improves manual rotational adjustment by using plastic handle 120. The second disc also reduces vibration that may occur during crimping operations.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. In an electrical terminal applicator which includes an application ram drivable by a press ram through working stroke towards, and a return stroke away from, a crimping anvil, a first crimping die on the applicator ram for cooperation with an anvil to crimp a first portion of an electrical terminal onto an exposed end of a conductive core of an insulated electrical wire during each working stroke of the applicator ram, a second crimping die on the applicator ram for cooperation with an anvil to crimp a second portion of the terminal onto the insulation of the electrical wire during each working stroke of the applicator ram, a first adjusting plate means mounted for angular adjustment about an axis on and extending in the direction of movement of the applicator ram to selectively interpose projection means between the press ram and the applicator ram to adjust the shut height of the first crimping die, a second adjusting plate means mounted for angular adjustment about said axis to selectively interpose projection means between the first adjusting plate means and the second crimping die to adjust the shut height of the second die, and a third adjusting plate means mounted for angular adjustment about said axis to selectively interpose projection means between the press ram and the first adjusting plate means to provide further adjustment of the shut height of the first die and, in turn, the shut height of the second die, wherein the improvement comprises:

said third adjusting plate means includes a thin flexible disc having a plurality of apertures arranged in a circle concentric about said axis, and said projection means includes a plurality of precision machined diskettes of a greater thickness than the disc and mounted in the apertures therein, the diskettes having varying thicknesses to provide a range of adjustments.

2. In an electrical terminal applicator as set forth in claim 1, wherein said third adjusting plate means includes a second flexible disc juxtaposed against the first flexible disc, the second flexible disc including apertures to accommodate said diskettes.

3. In an electrical terminal applicator as set forth in claim 1, wherein said apertures in the thin flexible disc include small tabs projecting radially inwardly of the peripheries of the apertures, and each diskette includes tab-receiving recess means in the periphery thereof whereby the diskettes can be snapped into positions in the apertures with the tabs snapping into the recess means.

4. In an electrical terminal applicator as set forth in claim 3, wherein said recess means comprise peripheral grooves about the diskettes.

5. In an electrical terminal applicator as set forth in claim 1, wherein said thin flexible disc is fabricated of sheet metal material.

6. In an electrical terminal applicator as set forth in claim 1, including indexing means to hold the thin flexible disc in any one of a plurality of discrete positions of angular adjustment.

7. In an electrical terminal applicator as set forth in claim 6, wherein said indexing means comprise a plurality of detent openings in the disc and a spring loaded detent ball biased axially toward the disc for positioning in one of the detent openings.

8. In an electrical terminal applicator which includes an application ram drivable by a press ram through working stroke towards, and a return stroke away from, a crimping anvil, a first crimping die on the applicator ram for cooperation with an anvil to crimp a first portion of an electrical terminal onto an exposed end of a conductive core of an insulated electrical wire during each working stroke of the applicator ram, a second crimping die on the applicator ram for cooperation with an anvil to crimp a second portion of the terminal onto the insulation of the electrical wire during each working stroke of the applicator ram, a first adjusting plate means mounted for angular adjustment about an axis on and extending in the direction of movement of the applicator ram to selectively interpose projection means between the press ram and the applicator ram to adjust the shut height of the first crimping die, a second adjusting plate means mounted for angular adjustment about said axis to selectively interpose projection means between the first adjusting plate means and the second crimping die to adjust the shut height of the second die, and a third adjusting plate means mounted for angular adjustment about said axis to selectively interpose projection means between the press ram and the first adjusting plate means to provide further adjustment of the shut height of the first die and, in turn, the shut height of the second die, wherein the improvement comprises:

said third adjusting plate means includes a thin flexible disc having a plurality of precision machined diskettes of a greater thickness than the disc arranged in a circle concentric about said axis, the diskettes having varying thicknesses to provide a range of adjustments.

9. In an electrical terminal applicator as set forth in claim 8, wherein said thin flexible disc has a plurality of apertures and said diskettes are mounted in said apertures.

10. In an electrical terminal applicator as set forth in claim 8, wherein said third adjusting plate means includes a second flexible disc juxtaposed against the first flexible disc, the second flexible disc including apertures to accommodate said diskettes.

11. In an electrical terminal applicator which includes an applicator ram drivable by a press ram through a working stroke towards, and a return stroke away from, a crimping anvil, a crimping die on the applicator ram for cooperation with the anvil to crimp a portion of an electrical terminal onto an electrical wire during each working stroke of the applicator ram, and adjusting plate means mounted for angular adjustment about an axis on and extending in the direction of movement of the applicator ram to selectively interpose projection means between the press ram and the applicator ram to adjust the shut height of the crimping die, wherein the improvement comprises:

a flexible sheet metal adjusting plate mounted for rotation about said axis to selectively interpose projection means between the press ram and said adjusting plate means to provide further adjustment of the shut height of the crimping die, and said flexible plate has a plurality of apertures arranged in a circle concentric about said axis, and said projection means includes a plurality of diskettes of a greater thickness than the plate and mounted in the apertures therein, the diskettes having varying thicknesses to provide a range of adjustments.

12. In an electrical terminal applicator as set forth in claim 11, wherein said flexible plate comprises a first flexible plate, and including a second flexible plate juxtaposed against the first flexible plate, the second flexible plate including apertures to accommodate said diskettes.

13. In an electrical terminal applicator as set forth in claim 12, wherein said apertures in the flexible plate include small tabs projecting radially inwardly of the peripheries of the apertures, and each diskette includes tab-receiving recess means in the periphery thereof whereby the diskettes can be snapped into positions in the apertures with the tabs snapping into the recess means.

14. In an electrical terminal applicator as set forth in claim 11, wherein said apertures in the flexible plate include small tabs projecting radially inwardly of the peripheries of the apertures, and each diskette includes tab-receiving recess means in the periphery thereof whereby the diskettes can be snapped into positions in the apertures with the tabs snapping into the recess means.

15. In an electrical terminal applicator as set forth in claim 14, wherein said recess means comprises a peripheral groove about the diskettes.

16. In an electrical terminal applicator as set forth in claim 15, wherein said flexible plate comprises a first flexible plate, and including a second flexible plate juxtaposed against the first flexible plate, the second flexible plate including apertures to accommodate said diskettes.

17. In an electrical terminal applicator as set forth in claim 11, including indexing means to hold the flexible plate in any one of a plurality of discrete positions of angular adjustment.

18. In an electrical terminal applicator as set forth in claim 17, wherein said indexing means comprise a plurality of detent openings in the flexible plate and a detent ball for positioning in one of the detent openings.

19. In an electrical terminal applicator as set forth in claim 18, wherein said flexible plate further includes a radially projecting handle to permit rotation of said plate.

* * * * *